US008157714B2

(12) United States Patent
Mayr

(10) Patent No.: US 8,157,714 B2
(45) Date of Patent: Apr. 17, 2012

(54) DYNAMIC BALANCE REFORMER EXERCISE APPARATUS

(75) Inventor: Barbara Mayr, Vienna (AT)

(73) Assignee: Balanced Body, Inc., Sacramento, CA (US)

( * ) Notice: Subject to any disclaimer, the term of this patent is extended or adjusted under 35 U.S.C. 154(b) by 37 days.

(21) Appl. No.: 12/759,341

(22) Filed: Apr. 13, 2010

(65) Prior Publication Data

US 2011/0251031 A1 Oct. 13, 2011

(51) Int. Cl.
*A63B 26/00* (2006.01)

(52) U.S. Cl. ..... 482/142; 482/121; 482/130

(58) Field of Classification Search ..... 482/68, 482/69, 72, 95, 96, 123, 126, 128–130, 132–135, 482/137, 140, 142, 146
See application file for complete search history.

(56) References Cited

U.S. PATENT DOCUMENTS

| | | | | | |
|---|---|---|---|---|---|
| 1,239,279 | A | * | 9/1917 | Loeblein, W. P. | 297/272.1 |
| 1,383,727 | A | * | 7/1921 | Kohn | 5/102 |
| 1,979,716 | A | * | 11/1934 | Terry | 482/72 |
| 2,106,927 | A | * | 2/1938 | Kinnear | 5/106 |
| 2,405,024 | A | * | 7/1946 | Eynon | 482/97 |
| 2,486,466 | A | * | 11/1949 | Davis | 5/93.1 |
| 2,553,862 | A | * | 5/1951 | Morris | 5/105 |
| 2,578,372 | A | * | 12/1951 | Pope | 5/106 |
| 3,010,719 | A | * | 11/1961 | Johnson | 472/114 |
| 4,037,834 | A | * | 7/1977 | Oaks | 482/27 |
| 4,183,521 | A | * | 1/1980 | Kroeker | 482/146 |
| 4,205,876 | A | * | 6/1980 | Cetina | 297/118 |
| D313,521 | S | * | 1/1991 | Hassel et al. | D6/501 |
| 5,547,443 | A | * | 8/1996 | Chen | 482/72 |
| 6,086,147 | A | * | 7/2000 | Gladstone | 297/133 |
| 7,553,261 | B2 | * | 6/2009 | Carbone | 482/72 |
| 7,951,056 | B2 | * | 5/2011 | Radzwill | 482/142 |
| 2005/0049117 | A1 | | 3/2005 | Rodgers, Jr. | |
| 2005/0101450 | A1 | * | 5/2005 | Gramaccioni | 482/72 |
| 2006/0252616 | A1 | | 11/2006 | Gerschefske | |
| 2007/0099764 | A1 | | 5/2007 | Eschenbach | |

OTHER PUBLICATIONS

International Search Report and Written Opinion, dated Dec. 23, 2011, from corresponding International Application No. PCT/US2011/031510.

* cited by examiner

*Primary Examiner* — Loan Thanh
*Assistant Examiner* — Daniel F Roland
(74) *Attorney, Agent, or Firm* — Greenberg Traurig, LLP

(57) ABSTRACT

A reformer exercise apparatus is disclosed that has a generally rectangular frame with a head end and a foot end and parallel spaced tracks therebetween supporting a movable carriage thereon. The frame includes a foot support at the foot end of the frame and one or more elastic resistance members fastened between the carriage and the foot end of the frame. Supporting the frame is a first rocking support assembly supporting the head end of the frame and a second rocking support assembly supporting the foot end of the frame, whereby the frame can rock from side to side to provide a dynamic feedback to a user of the apparatus as to whether or not the user is properly centered on the apparatus. A kit for changing a conventional reformer into a rocking reformer apparatus is also disclosed.

6 Claims, 6 Drawing Sheets

DYNAMIC BALANCE REFORMER EXERCISE APPARATUS

BACKGROUND OF THE DISCLOSURE

1. Field of the Disclosure

The present disclosure relates to reformer exercise apparatuses. In particular, it relates to a reformer provided with a dynamic balancing capability.

2. State of the Art

Exercise machines utilized in the performance of physical exercises originated by Joseph Pilates typically are performed on a stationary apparatus called a reformer. A classical Pilates reformer has a rectangular frame supporting two parallel rails or tracks. A wheeled carriage rides on these tracks and is resiliently biased toward a foot end of the frame by one or more elastic members, typically coil springs. A user sits or lies on the carriage and pushes against a foot support bar at the foot end to move the carriage away from and toward the foot end. Alternatively, the user may grasp ends of a pair of ropes or straps that pass through pulleys at the head end of the frame and are attached to the carriage to similarly pull the carriage away from and toward the foot end of the frame.

A major emphasis in Pilates training is on core musculature stabilization. The exercises being performed on the reformer ideally are conducted carefully by the user concentrating on body symmetry and symmetrical body movement and proper alignment during exercise. It is often somewhat difficult for a user to sense when he or she is properly centered on the reformer, and exerting equal forces with both arms or both legs during movements required.

There is therefore a need for a mechanism to provide a user with dynamic feedback to aid in facilitating sense of proper alignment during exercise activity on a reformer.

SUMMARY OF THE DISCLOSURE

A reformer in accordance with the present disclosure dynamically provides a user with direct feedback of alignment deficiencies and provides a direct sensation of proper body positioning during exercises performed on a reformer. One embodiment of a rocking reformer of the present disclosure has a rocking base assembly at each of the head end and the foot end for positioning the reformer on a flat support surface, such as a floor, instead of integral stationary straight legs. Another embodiment in accordance with the present disclosure is a rocking base assembly kit for supporting a conventional reformer apparatus. The rocking base kit preferably includes a pair of rocker bases each having a pair of stop blocks, and may optionally include a set of spring cradles.

The rocking base assembly may completely replace the legs of the reformer or alternatively may simply be positioned beneath the legs of a conventional reformer. This rocking base permits the reformer to rock from side to side during use, and remains level only when a user is properly oriented and centered on the reformer, thus providing the user with immediate sensory feedback of any misalignment during an exercise.

In the configuration in which a pair of rocker bases are applied to a conventional reformer, the overall height of the reformer is raised about 6-8 inches. This increase in height may be desirable to the user even without activation of the rocking feature by removal of the stop blocks from the rockers. Typical reformers are about 14 inches high. The additional height, making the reformer 18-20 inches high, can provide a desirable sitting height above a floor for many users. The result is a versatile reformer apparatus that can be used both as a stationary reformer and a rocking reformer to provide the user with an enhanced dynamic exercise experience.

Thus, described herein is a rocking base assembly for supporting a reformer exercise apparatus having an elongated rectangular frame adapted to be positioned parallel to a flat support surface. The reformer frame has head and foot ends. The rocking base assembly preferably includes a pair of rocker bases each having a platform portion for supporting one end of the reformer frame and a rocker member beneath the platform portion. The rocker member has a bottom curved surface portion that is preferably fastened to the platform portion. Alternatively, the rocker member and platform portion may be integral parts of a rocker base. The bottom curved surface portion of the rocker member merges with straight end portions to guard against upset of the rocker assembly supported reformer exercise apparatus.

The platform portion of the rocking base may have a guide rail on an upper surface thereof for positioning the reformer frame thereon. The assembly may also include a pair of removable stop blocks each having a central recess that has a bottom shape complementary to that of one of the straight end portions of the rocker member. Each block has at least one upright side wall and more preferably each block has a pair of upright side walls with the central recess therebetween.

Another aspect of the present disclosure is a reformer exercise apparatus that has a generally rectangular frame having a head end and a foot end and having parallel spaced tracks therebetween supporting a movable carriage thereon, a first rocking support assembly supporting the head end of the frame and a second rocking support assembly supporting the foot end of the frame. Each rocking support assembly has a generally flat platform portion engaging and supporting one of the head and foot ends of the frame and a rocker member beneath the platform, wherein the rocker member has a bottom curved surface portion between straight end portions. The curved surface portion is arcuate and preferably has a radius of between 24 and 48 inches.

Another aspect of the present disclosure is a kit for changing a conventional reformer apparatus having four legs into a rocking reformer apparatus. The kit includes two rocking support bases, each base having a rocker platform portion adapted to be positioned beneath and support two of the legs and a rocking member beneath the platform portion, wherein the rocker member has a bottom curved surface portion between straight end portions. The kit includes a pair of removable blocks each having a central recess shaped complementary to that of one end portion of the rocker member. The platform portion has a pair of recesses in an upper surface of the platform portion each shaped to receive one of the four legs of a reformer apparatus therein.

In another aspect, the platform portion of each base preferably has an upright peg extending from an upper surface of the platform portion for receiving a ballast weight thereon. This ballast weight is optionally used to change the center of gravity of the reformer exercise apparatus. Finally, a latch or locking device may be included with each of the stop blocks to fasten the block in position beneath the platform portion of the base to preclude inadvertent removal of the stop block.

BRIEF DESCRIPTION OF THE DRAWINGS

The disclosure will be better understood and objects, other than those set forth above, will become apparent when consideration is given to the following detailed description. Such description makes reference to the accompanying drawings wherein.

DETAILED DESCRIPTION

In the following description, numerous specific details are set forth in order to provide a more thorough disclosure. It will be apparent, however, to one skilled in the art, that the art disclosed may be practiced without these specific details. In some instances, well-known features may have not been described in detail so as not to obscure the art disclosed. In the several views, like numbers are used to identify like components and subcomponents where appropriate.

Figure 1:
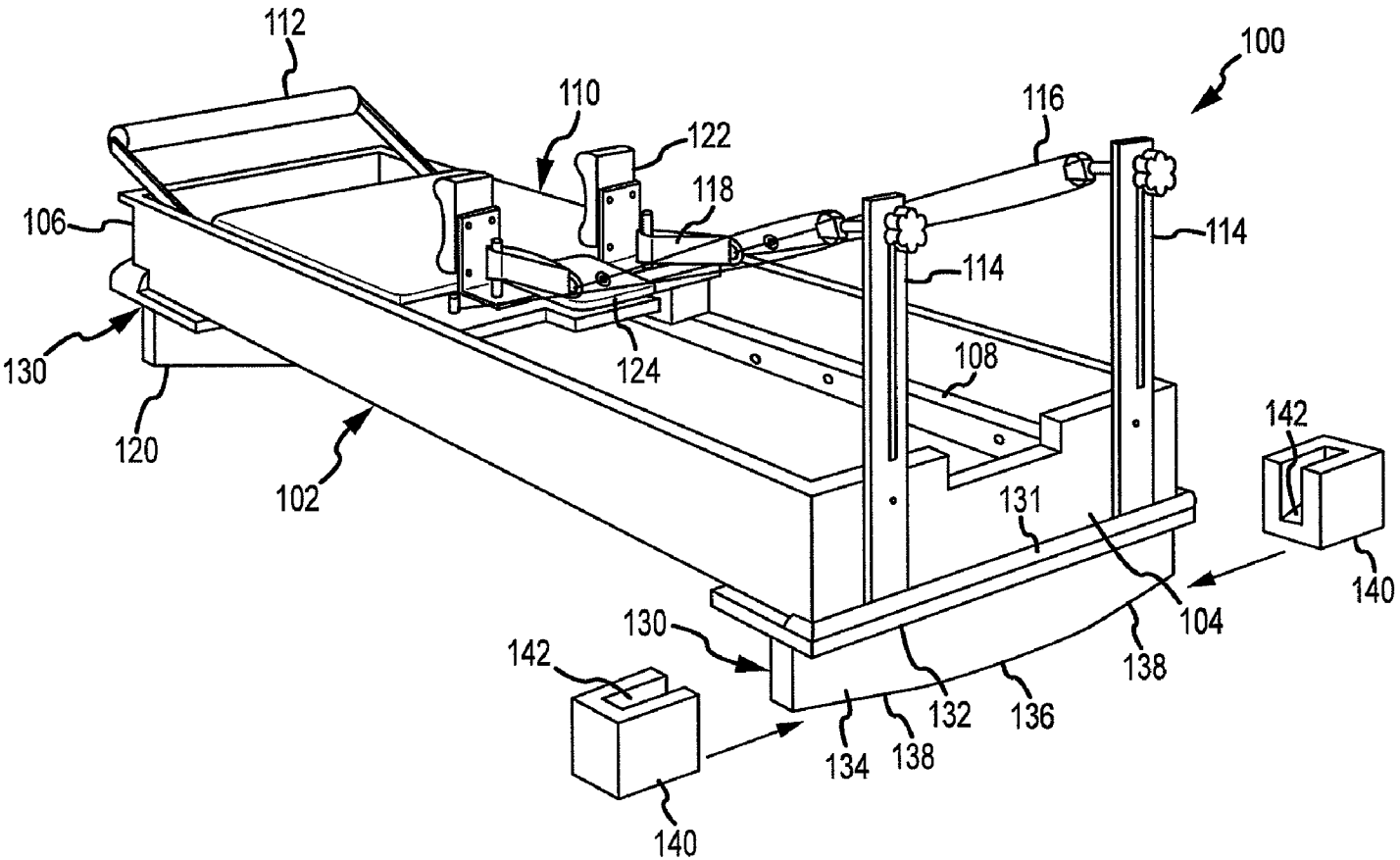
FIG. 1 is a perspective view of a first embodiment of a reformer exercise apparatus incorporating rocking assemblies in accordance with the present disclosure.

A perspective view of a reformer apparatus 100 in accordance with one embodiment of the present disclosure is shown in FIG. 1. This particular reformer 100 comprises a generally rectangular frame 102 having a head end 104 and a foot end 106 and a pair of parallel track or rail members 108 separating the head end 104 from the foot end 106. A movable carriage 110 rides on four roller/guide wheel assemblies (not shown, These wheel assemblies roll on the track members 108 to support and guide movement of the carriage 110 back and forth along the track members 108 of the frame 102. A plurality of elastic members, e.g., coil springs (not shown) are selectively connected between the carriage 111 and the foot end 106 of the frame 102 to bias the carriage 110 toward the foot end 106.

A foot bar assembly 112 is removably fastened to the frame 102 near the foot end 106 so as to provide a stationary support for a user of the apparatus 100 to push against while reclining or sitting on the carriage 110 in order to move the carriage 110 back and forth along the track members 108.

The head end 104 is designed to space the rail members 108 rigidly apart, and preferably supports a pair of upright arms 114 that carry pulleys through which arm cords 116 pass. These arm cords 116 each have one end removably attached to the carriage 110, with the other end attached to a hand loop 118. In certain exercises, the arm cords are grasped by a user and pulled in order to move the carriage 110 toward the head end 104 rather than the user pushing against the foot bar assembly 112.

The carriage 110 comprises a flat support platform which has a generally rectangular shape. A cushion pad 120 is secured to an upper surface of the platform. A pair of shoulder stops 122 are spaced apart near the head end of the carriage 110. These shoulder stops 122 engage with a user's shoulders when the user lies on his or her back on the carriage 110 while exercising on the apparatus 100. A padded headrest 124 is fastened via a hinge at its base end to the platform 120 between the shoulder stops 122.

At each of the head end 104 and foot end 106 of the reformer frame 102 is a rocking support assembly 130 in accordance with a first embodiment of the present disclosure. This rocking support assembly 130 includes a flat rectangular platform 132 upon which one of the head or foot end of the reformer 102 rests. This platform may be fastened to the frame 102 or it may be removable. A guide rail 131 is provided in this embodiment to maintain the frame 102 in proper oriented position on the rocking assembly 130. This guide rail 131 is preferably a C shaped member that centers the head or foot end of the reformer frame 102 on the platform 132.

Figure 3:
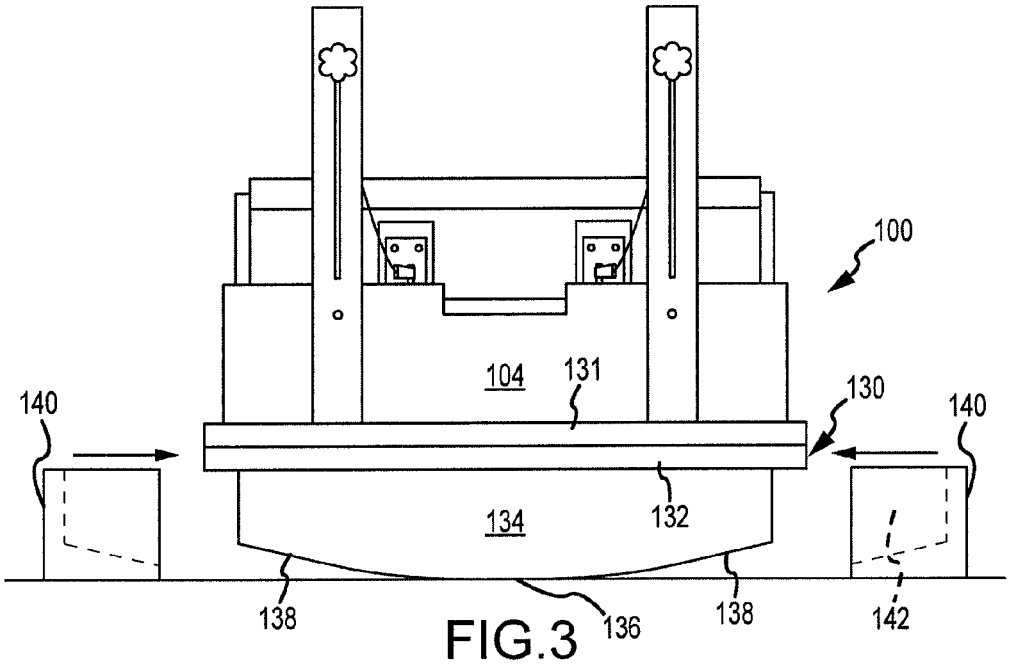
FIG. 3 is an end view of the exercise apparatus shown in FIG. 1 shown in a dynamic balancing position.

The rocking assembly 130 also has a rocker 134 fastened to an underside of the support platform 132. The bottom of this rocker 134, as is best shown in FIG. 3, has a curved middle bottom surface portion 136. The curved middle bottom surface portion 136 is tangent to and merges with straight end portions 138. The curved middle portion 136 can have circular arcuate shape. This shape may have a radius of curvature between about 24-48 inches, and may preferably be about 30 inches. The combination of a curved bottom surface middle portion 136 between two tangent straight portions 138 ensures that the reformer 100 cannot tip too far from side to side during use.

A user lying on the reformer 100 first aligns his or herself on the reformer carriage 110 so that she is longitudinally centered on the reformer 100. In this position, the rocker supported reformer 110 will be balanced as is shown in FIG. 3 with a combined center of gravity passing vertically through the middle of the curved surface 136 as is shown in FIG. 3. During exercise, if the user moves off center, she will become unbalanced on the reformer 100 and the reformer will tilt either left or right (according to the end view as in FIG. 3). This tilt gives the user dynamic feedback instantaneously as to whether proper centering and core positioning is being maintained. Should the user unbalance enough to tilt the reformer farther, the straight portions of the rocker base 134 engage the floor or other horizontal stationary support surface, making a rigid support, preventing further tilt positioning.

Figure 4:
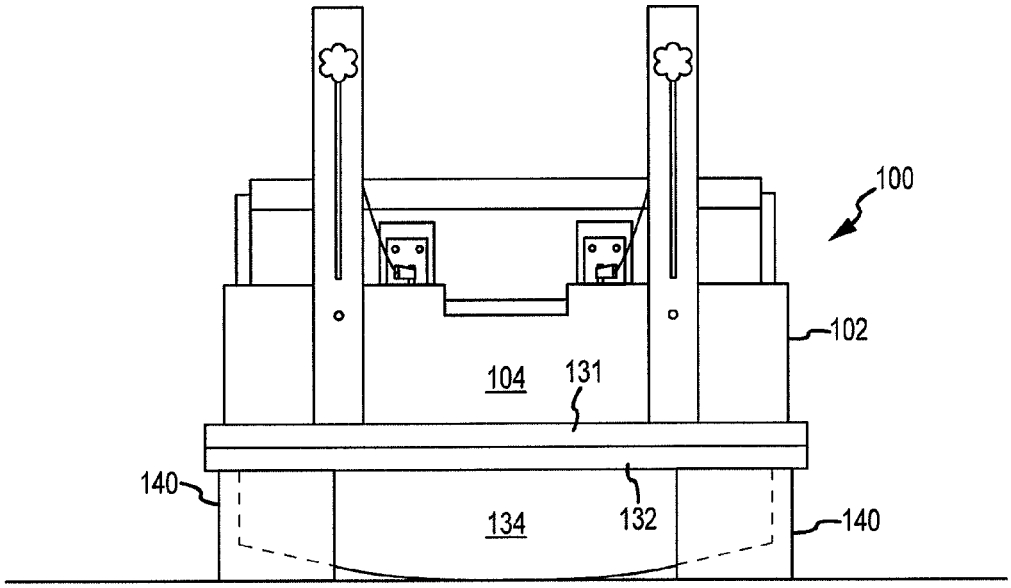
FIG. 4 is an end view as in FIG. 3 but showing the reformer in a static position with support blocks preventing rocking motion of the reformer exercise apparatus.

Each rocking assembly 130 includes a pair of removable support blocks 140. The support block 140 has a recess 142 having a complementary shape to that of the angle of the straight portions 138 when the rocking assembly 130 is resting centered on a flat surface. Each support block 140 is sized to easily slip around and beneath one of the ends of the rockers 134 such that the straight portion 138 of the rocker 134 is securely held within the recess 142 as is shown in FIG. 4. Since only the straight portions 138 fit within the recesses 142 rather than curved portion 136, a pair of the support blocks 140 provides a static stationary support for the end of the reformer 100 carried thereon. A pair of assemblies 130 replace the four legs that typically support a reformer 100 in this embodiment.

Figure 2:
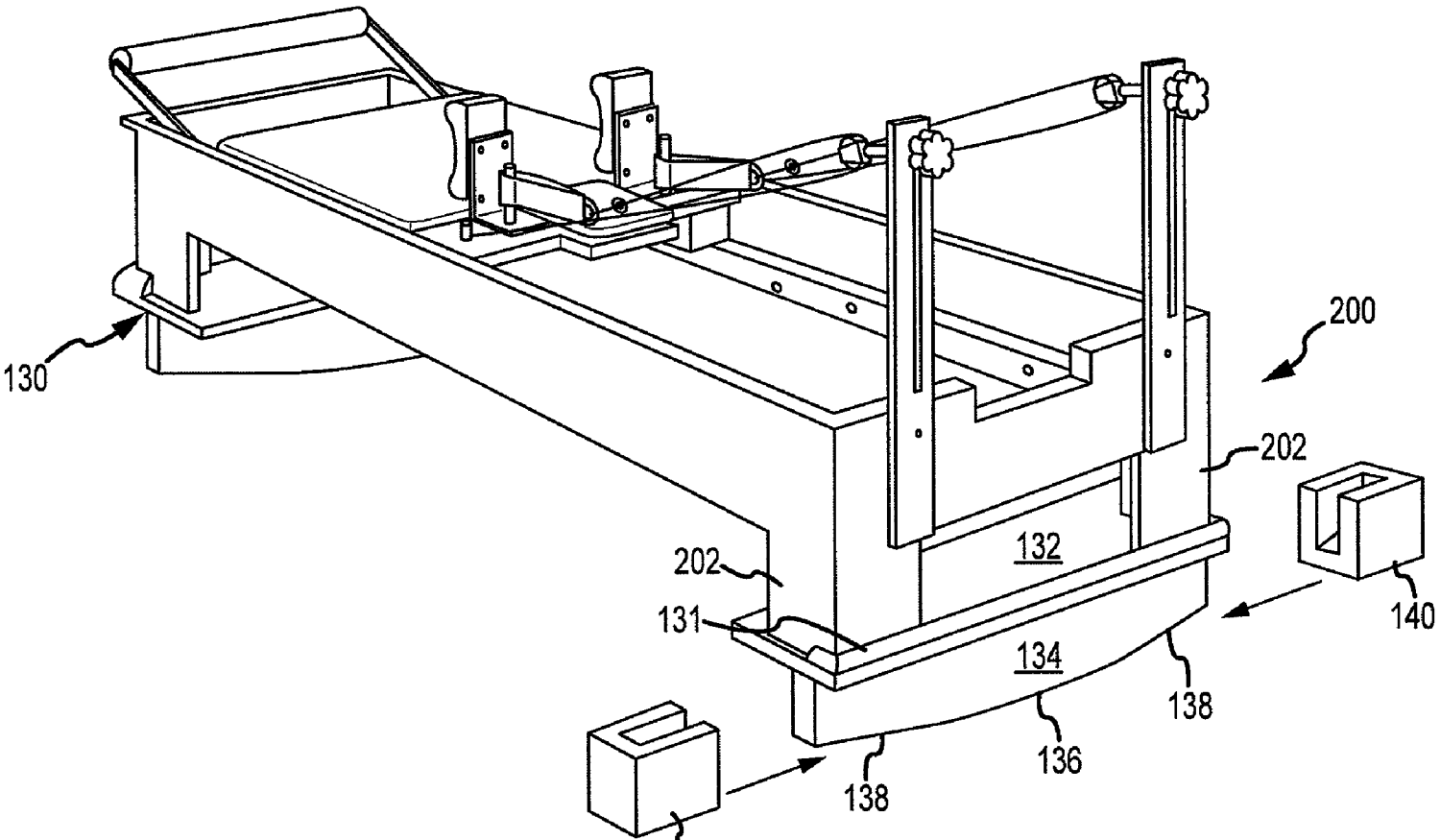
FIG. 2 is a perspective view of second embodiment of a reformer exercise apparatus supported by a rocking assembly in accordance with the present disclosure.

A second embodiment of a reformer exercise apparatus 200 is shown in FIG. 2. The primary difference here is that a conventional reformer 200 has legs 202 which are, in turn, supported by the platform 132 of the rocking base assembly 130 as previously described. Thus a pair of the rocking assemblies 130 may be used to convert any conventional reformer into a dynamic rocking reformer in accordance with the present disclosure.

Various modifications and alternatives to the disclosed embodiments will be apparent to those skilled in the art. For example, the platform 132 and rocker 134 are shown as wide, solid members, preferably made of wood. Alternatively these components may be a single structure formed of plastic, wood or other rigid material. The rocker 134 may be formed with a pair of thin parallel rails, or may be a plastic molded body having other than having a rectangular vertical cross sectional shape as shown.

The platform 132 is shown as being rectangular in shape. Other shapes are envisioned as well. The rails 131 may be replaced by indentations or slots in the surface of the platform 132, and/or may be integrally formed as part of the platform 132, or may be eliminated altogether. Further, the blocks 140 are shown having two parallel vertical side walls. The blocks 140 may be formed with only one side wall to serve a function of supporting the platform 132 parallel to a floor or other support surface. Finally, although not shown, a pin and through bore arrangement may be provided in the block 140 to match a corresponding hole through the rocker 134 to latch the support block 140 onto the rocker 134 and preclude inadvertent removal of the support block 140.

During reformer operation, one or more of the springs that are connected to the carriage 110 may not be connected to the foot end 106 of the frame 102. This is typically the case during operation of the reformer. Usually there are 5 or 6 springs available to be connected to an anchor structure (not shown) at the foot end of the frame 102. Some may be light springs and others may be heavier weight so that a combination of springs are used to give the proper resistance rate for a particular exercise for a given user. The springs that are not attached typically rest on a rigid stirrup strap that is carried beneath the carriage 110. The stirrup strap retains the springs in general alignment with the anchor hook that the user would attach the spring to at the foot end of the frame 102.

Figure 5:
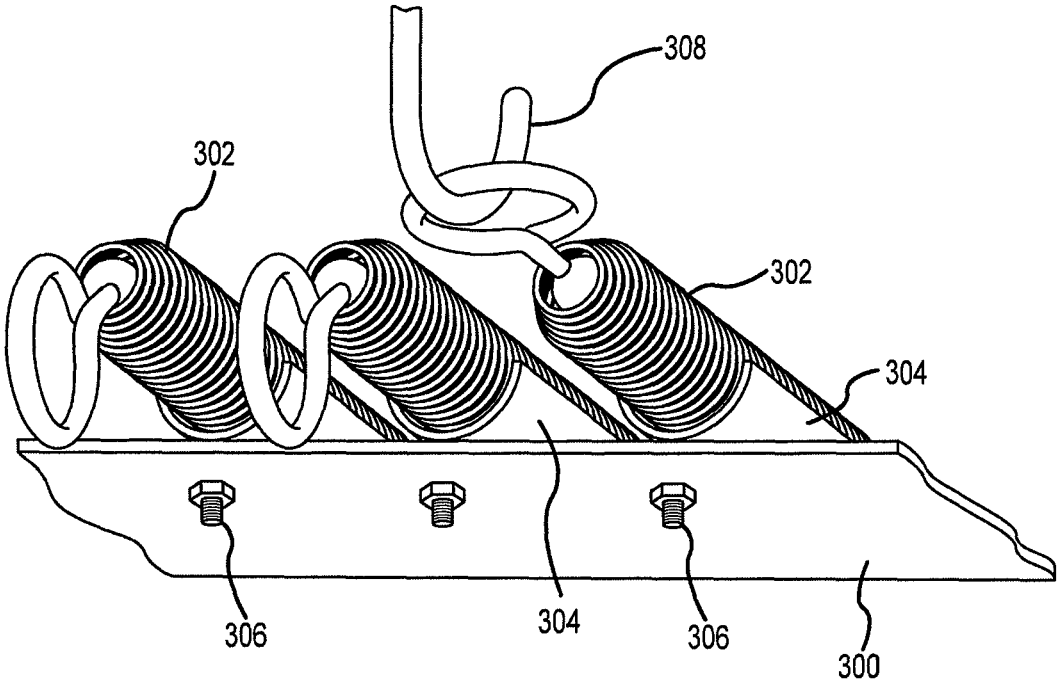
FIG. 5 is a partial underside view of the carriage showing a portion of the spring support structure beneath the carriage in a reformer exercise apparatus of the present disclosure.

A partial underside view of a carriage 110 showing a stirrup strap 300 and several springs 302 is shown in FIG. 5. Each of the springs 302, when not attached to an anchor hook 308, is supported in a rubber cradle 304 that is fastened to the strap 300 by a bolt 306. These cradles 304 are optional. They are used to prevent the idle springs 302 from making noise as they would otherwise do when they slide back and forth during rocking motion of the reformer 100.

Figure 6:
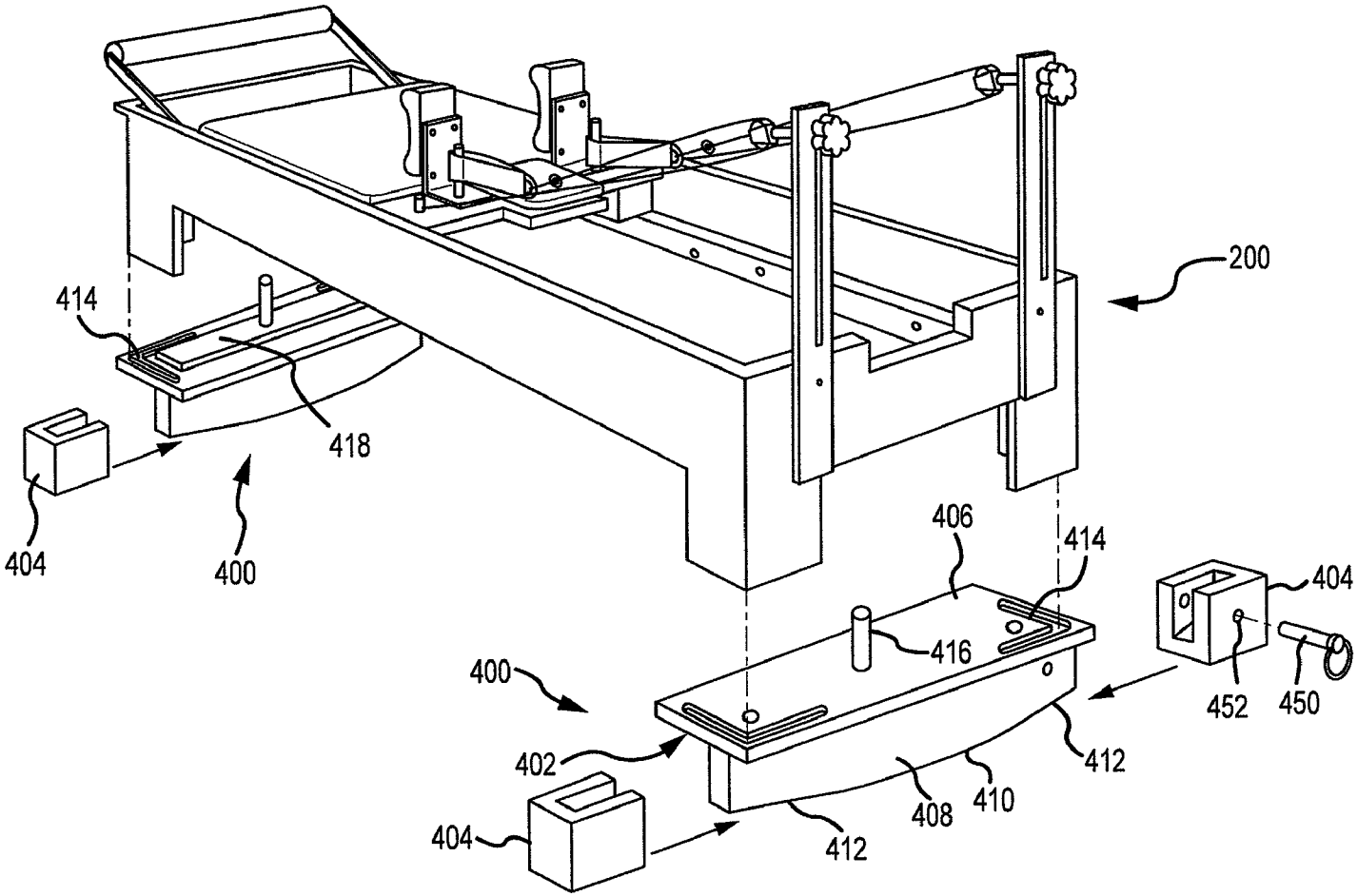
FIG. 6 is an exploded view of a conventional reformer with a rocking base kit in accordance with another embodiment of the present disclosure.

An exploded view of a reformer 200 positioned above an alternative set of rocking assemblies 400 is shown in FIG. 6. Each rocking assembly 400 comprises a rocker 402 and a pair of blocks 404. Each rocker 402 includes a flat plate portion 406 fastened to a curved rocker portion 408. As in the first embodiment described above, the curved rocker portion 408 has a central bottom curved portion 410 bounded between tangent straight portions 412. The central curved portion 410 is preferably a circular arc and preferably has a radius of curvature in a range between 24 and 48 inches and more preferably a radius of around 30 inches. The straight portions 412 may be between 10 and 15 inches in length.

Preferably the plate portion 406 has a pair of L shaped recesses 414 routed into its upper surface complementary in shape to that of the reformer legs so as to receive the lower end of each leg at one end of the reformer 200. These two recesses 414 securely hold the rocker 402 in place beneath the reformer 200. The plate portion 406 also preferably has at least one centrally located peg 416 projecting upward from its upper surface. This peg 416 is sized to receive a ballast weight to lower the center of gravity of the rocking reformer 100 or 200 during use. The peg 416 is preferably a one inch dowel sized to receive standard weights such as a standard 10 or 12 inch body building weight. Alternatively the weight may be of any other suitable shape and size, such as a rectangular plate 418.

Figure 7:
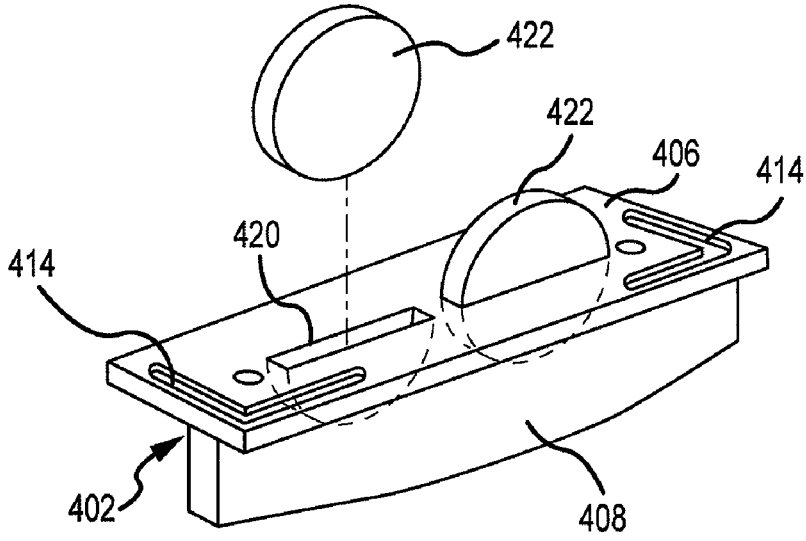
FIG. 7 is a separate perspective view of one of the rocking base platforms shown in FIG. 6 having spaced slots for optional weights.
Figure 8:
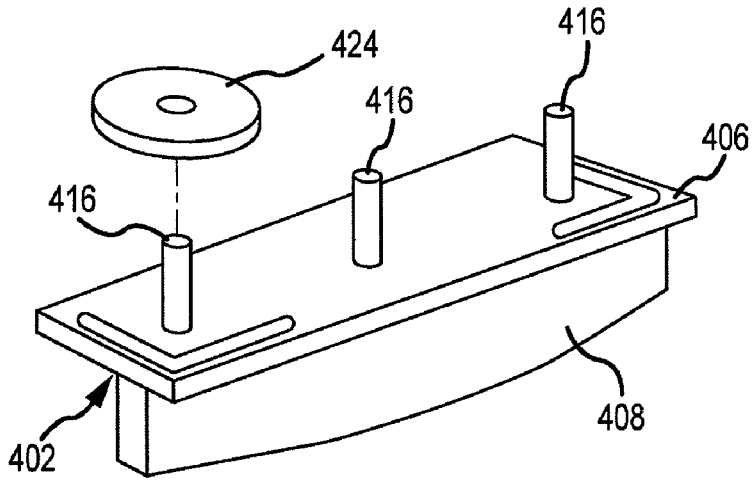
FIG. 8 is a view as in FIG. 7 showing an alternative weight support configuration.

Alternative arrangements for carrying ballast weights are shown in FIGS. 7 and 8. In FIG. 7, the platform portion 406 has a pair of vertical slots 420 formed therein to receive ballast discs 422. In FIG. 8, the platform portion 406 has a set of two or three pegs 416 to receive ballast weights or discs 424. Other arrangements could also be used. For example, the rocker member may have a slot therein that can be either filled with a weighting material or sized to receive a ballast weight. Instead of pegs 416, one or more clips may be used to secure one or more ballast weights in position on the platform portion 406.

Again, various modifications may be made to the rocking assemblies described above. Each rocking assembly 130, 400 may be made of any substantially rigid material such as wood, metal, or a molded plastic material. The upper surface 132 or 406 may be fitted with a rail 131 or may have grooves or slots 414 to receive and hold the reformer 100, 200 end or feet securely in position. The rocking assembly may be made an integral part of the reformer or may be utilized as an accessory kit for a conventional reformer. An adhesive or cushioning material may be placed in each of the L shaped recesses 414 to receive the legs of the reformer 100 or 200. Each of the blocks 404 may be equipped, as shown in FIG. 6, with latch or locking device such as a pin 450 to fit within a bore 452 through the block 404 and into a bore 454 through the rocker portion 408 of the rocker 402 to preclude inadvertent removal of the block 404. Such a pin locking device could also be configured for insertion vertically through the platform portion into the block 404. Other latching mechanisms could alternatively be utilized. These are only exemplary variations. Other modifications will be readily apparent to one skilled in the art. Accordingly, all such alternatives, variations and modifications are intended to be encompassed within the scope of and as defined by the following claims.

What is claimed is:

1. A reformer exercise apparatus comprising:

a generally rectangular frame having a head end and a foot end and having parallel spaced tracks therebetween supporting a movable carriage thereon; and a first rocking support assembly supporting the head end of the frame and a second rocking support assembly supporting the foot end of the frame, wherein each rocking support assembly has a platform portion engaging and supporting one of the head and foot ends of the frame and a rocker member beneath the platform having a bottom curved surface portion, wherein each rocking support assembly is removable from the reformer frame, and wherein each support assembly further comprises a pair of removable blocks each having a central recess for receiving an end portion of the rocker member and having at least one upright side wall engagable with the platform portion.

2. The apparatus according to claim 1 wherein each rocking support assembly has a generally flat platform portion engaging and supporting one of the head and foot ends of the frame and a rocker member beneath the platform, wherein the rocker member has a bottom curved surface portion between straight end portions.

3. The apparatus according to claim 2 wherein the curved surface portion is arcuate having a radius of between 24 and 48 inches.

4. A reformer exercise apparatus comprising:

a generally rectangular frame having a head end and a foot end and having parallel spaced tracks therebetween supporting a movable carriage thereon; and a first rocking support assembly supporting the head end of the frame and a second rocking support assembly supporting the foot end of the frame, wherein each rocking support assembly has a generally flat platform portion engaging and supporting one of the head and foot ends of the frame and a rocker member beneath the platform having a bottom curved surface portion between straight end portions, wherein each rocking support assembly is removable from the reformer frame, and wherein each support assembly further comprises a pair of removable blocks each having a central recess having a bottom shape complementary to that of end portions of the rocker member and having at least one upright side wall engagable with the platform portion.

5. The apparatus according to claim 4 wherein each block has a pair of upright side walls with the central recess therebetween.

6. The apparatus according to claim 4 wherein the platform portion is adapted to hold thereon a ballast weight.

* * * * *